US012473913B2

(12) United States Patent
Haas

(10) Patent No.: US 12,473,913 B2
(45) Date of Patent: Nov. 18, 2025

(54) HYDRAULIC PUMP UNIT HAVING KNURLED CONNECTION OF A PILLOW BLOCK TO A HOUSING

(71) Applicant: Schaeffler Technologies AG & Co. KG, Herzogenaurach (DE)

(72) Inventor: Maximilian Haas, Bühl (DE)

(73) Assignee: Schaeffler Technologies AG & CO. KG, Herzogenaurach (DE)

( * ) Notice: Subject to any disclaimer, the term of this patent is extended or adjusted under 35 U.S.C. 154(b) by 0 days.

(21) Appl. No.: 18/567,813

(22) PCT Filed: May 2, 2022

(86) PCT No.: PCT/DE2022/100327
§ 371 (c)(1),
(2) Date: Dec. 7, 2023

(87) PCT Pub. No.: WO2022/258099
PCT Pub. Date: Dec. 15, 2022

(65) Prior Publication Data

US 2024/0271619 A1 Aug. 15, 2024

(30) Foreign Application Priority Data

Jun. 8, 2021 (DE) ..... 10 2021 114 712.3

(51) Int. Cl.
*F04C 2/18* (2006.01)
*F01C 21/10* (2006.01)

(52) U.S. Cl.
CPC ..... *F04C 2/18* (2013.01); *F01C 21/10* (2013.01); *F04C 2240/30* (2013.01)

(58) Field of Classification Search
CPC ..... F04C 2/18; F04C 21/10; F04C 2240/30; F04C 2240/50; F04C 2230/60; F04B 53/16
See application file for complete search history.

(56) References Cited

U.S. PATENT DOCUMENTS

| | | | | |
|---|---|---|---|---|
| 3,207,079 | A | 9/1965 | Cook | |
| 4,231,727 | A | 11/1980 | Buchholz | |
| 5,722,776 | A | 3/1998 | White | |
| 2005/0084189 | A1* | 4/2005 | Oelsch | F16C 33/74 384/107 |

(Continued)

FOREIGN PATENT DOCUMENTS

| | | | |
|---|---|---|---|
| DE | 2904666 | A1 | 8/1979 |
| DE | 3321723 | A1 | 1/1984 |

(Continued)

*Primary Examiner* — Dapinder Singh

(57) ABSTRACT

According to the disclosure, a pillow block for a pump is connected to a housing by means of a knurl in order to form a hydraulic pump unit in that the knurl is pressed into a first region of a receptacle for the pillow block. The resulting chips can be received in a chip space which is secured by a projection of the pillow block so that the chips are prevented from moving towards the pump. The hydraulic pump unit is easy to install. The knurl allows the torque of the pump to be absorbed and supported in the housing so that precise operation of the pump is made possible. Furthermore, an anti-turn mechanism for the pillow block is obtained.

20 Claims, 1 Drawing Sheet

(56) References Cited

U.S. PATENT DOCUMENTS

| | | | | |
|---|---|---|---|---|
| 2007/0003424 | A1* | 1/2007 | Benco | F04C 18/0215 418/55.3 |
| 2011/0200466 | A1* | 8/2011 | VanBritson | F04C 29/06 415/229 |
| 2013/0266462 | A1 | 10/2013 | Bernreuther | |
| 2015/0275898 | A1* | 10/2015 | Ahire | F04C 23/008 418/55.2 |
| 2017/0016446 | A1* | 1/2017 | Yano | F04C 27/009 |
| 2017/0363084 | A1* | 12/2017 | Burn | H02K 7/14 |

FOREIGN PATENT DOCUMENTS

| | | | |
|---|---|---|---|
| DE | 3500817 | A1 | 10/1985 |
| DE | 2760391 | C2 | 12/1991 |
| DE | 10247668 | A1 | 4/2003 |
| JP | 2005127514 | A | 5/2005 |

* cited by examiner

HYDRAULIC PUMP UNIT HAVING KNURLED CONNECTION OF A PILLOW BLOCK TO A HOUSING

CROSS-REFERENCE TO RELATED APPLICATIONS

This application is the U.S. National Phase of PCT Application No. PCT/DE2022/100327 filed on May 2, 2022, which claims priority to DE 10 2021 114 712.3 filed on Jun. 8, 2021, the entire disclosures of which are incorporated by reference herein.

TECHNICAL FIELD

The present disclosure relates to a hydraulic pump unit, in particular for use in hydraulic actuation systems for motor vehicles, and an assembly method for a hydraulic pump unit. It deals in particular with the connection of a pillow block for a pump of the hydraulic pump unit to a housing of the hydraulic pump unit.

BACKGROUND

Hydraulic actuation systems are known for actuating actuators in automotive technology, for example for actuating clutches, parking locks or the like. A hydraulic system requires a pump to build up the necessary pressure of the hydraulic medium. The pump is normally mounted using pillow blocks, which must be secured against rotation in order to be able to absorb the frictional torques between the pump gear and the pillow block. It is assumed to be known that this takes place via a cross pin in the pillow block on a recess in the housing. Furthermore, a press fit between the pillow block and the housing is normally formed in a blind hole that has a ventilation opening. If the housing—as is assumed to be known—is made from an aluminum material, an additional processing step is required for this, in which the risk of chip formation is high. The ventilation opening regularly leads to a misalignment of the pillow block, which reduces the positioning accuracy and thus the efficiency of the pump and its accuracy.

SUMMARY

Proceeding therefrom, the object of the present disclosure is to at least partially overcome the problems known from the prior art.

This object is achieved with the features described herein. The features can be combined with one another in a technologically meaningful manner and can define further embodiments of the disclosure.

The hydraulic pump unit according to the disclosure comprises a pump, at least one pillow block for mounting the pump, and a housing. The housing includes a receptacle for each pillow block, and the receptacle has a first region of a first length which is shaped as a blind hole. The pillow block has a second region of a second length that is smaller than the first length. The second region is formed in the first region of the receptacle, and the second region has a peripheral knurl around its circumference that extends at least over a subregion of the second length with the knurl pressed into the first region.

Both the first region and the second region can be of cylindrical design. The knurl is formed on the outer circumference of the second region and has structures that effect a larger diameter in the region of the knurl than in the first region. As a result, when pressed into the first region, the knurl intersects a corresponding counter-structure, for example a serration, and an intimate connection is formed between the receptacle and the pillow block in the region of the knurl. This absorbs the torque generated during operation of the pump and braces it in the first region and thus in the housing. Due to the shorter design of the second region compared to the first region, a dead space is created in a press-in direction after the pressing-in operation, which is bounded by the base of the blind hole on the one hand and by an end face of the second region on the other hand (and peripherally by the first region). Given the previously described pressing-in operations, these bounds are fixed in position and thus the chip space could be described as a fixed volume chip space since this bounded volume remains constant. On the one hand, this dead space is useful during assembly, i.e. when pressing the pillow block into the receptacle, since the air present when the intimate connection between the knurl and the first region is formed does not need to escape and a ventilation opening can therefore be dispensed with. Thus, the air is compressed in the dead space but does not need to be removed. On the other hand, the dead space can also serve as a chip space, which receives the chips produced when the knurl is pressed into the first region. This is the case in particular when the knurl is formed at the tip of the second region in the press-in direction or is connected to the tip, for example via a corresponding chamfer.

The pillow block can thus be installed easily, in particular requiring no additional elements to absorb the torques. The pump is precisely positioned so that precise dosing or precise pressure build-up by the pump is possible without further measures.

The second region can have a press-fit region which is cylindrical and is press-fitted with the first region. In this way, centering and positioning of the pillow block in the receptacle can be further facilitated and improved.

The receptacle can have a recess in which the diameter of the receptacle increases from a first diameter in the first region to a third diameter and thus defines a third region of the receptacle. The pillow block has a projection in which the diameter of the pillow block increases from a second diameter in the second region to a fourth diameter, thus defining a fourth region of the pillow block. The fourth region is positioned in the third region of the receptacle, and the projection of the pillow block rests against the recess of the receptacle. The interaction of the projection, which serves as a collar, and the recess can thus further improve the containment of the chips produced, since the projection and the recess by their interaction form an effective barrier to the migration of chips.

The fourth region can have a press-fit region which is cylindrical and is press-fitted with the third region. In this way, centering and positioning of the pillow block in the receptacle can be further facilitated and improved.

The housing is made of a first material with a first Brinell hardness and the pillow block is made of a second material with a second Brinell hardness and the second Brinell hardness is greater than the first Brinell hardness. The knurl can be hardened, so that its Brinell hardness is well above the first Brinell hardness, in order to reduce the necessary press-in forces.

The housing can be made of a first material with a first tensile strength and the pillow block is made of a second material with a second tensile strength and a quotient of the second tensile strength divided by the first tensile strength is greater than 2.5. The housing is made of a first material with a first yield point Rp0,2 and the pillow block is made of a second material with a second yield point Rp0,2 and a quotient of the second yield point divided by the first yield point is greater than 2.5. A quotient or ratio of the second tensile strength to the first tensile strength and/or of the second yield point to the first yield point of 2.5 or more, in particular 3.0 or more, define exemplary embodiments that promote chip formation and thus a defined formation of the knurl structures can take place.

The housing can be made of an aluminum material and the pillow block can be made of steel. In particular, the knurl and in particular its profile is hardened further in order to make it easier to press the knurl into the first region or to reduce the press-in forces to be applied.

The first region designed as a blind hole has a base which is opposite an end face of the second region. The region between the base and the end face being designed as a chip space which receives chips produced when the knurl is pressed into the first region. The knurl and the chip space being connected to one another by a chamfer, through which the chips can pass from the knurl into the chip space. As a result, the chips produced when the knurl is pressed into the first region can be reliably collected without being able to move them in the direction of the pump.

In an example embodiment, a press-in direction of the pillow block into the receptacle is defined, and the second region has a groove, adjacent to the knurl in the press-in direction, which serves as a chip space which receives chips produced when the knurl is pressed into the first region. This enables a chip space to be formed remote from the dead space between the first region and the second region and increases the flexibility of the design of the hydraulic pump unit. At the same time, the chip space also enables the chips that are produced to be securely collected.

According to a further aspect of the disclosure, a method for assembling a hydraulic pump unit, in particular according to the present disclosure, is proposed. The hydraulic pump unit includes a pump, at least one pillow block for mounting the pump, and a housing. The housing includes a receptacle for each pillow block, and the receptacle has a first region of a first length, which is shaped as a blind hole. The pillow block has a second region of a second length that is smaller than the first length. The second region includes a circumferential knurl that extends at least over a subregion of the second length. The pillow block is first pressed into the receptacle so that the knurl is pressed into the first region and the second region of the pillow block is pressed into the first region of the receptacle. The pump is then mounted on the pillow block and is connected to this and the housing.

The details and advantages disclosed for the hydraulic pump unit can be transferred and applied to the assembly method and vice versa.

As a precaution, it should be noted that the numerical designations used here ("first", "second", etc.) serve primarily (only) to distinguish between several similar objects, sizes, or processes, and in particular no necessary dependency and/or sequence of these objects, sizes, or processes to each other is indicated. If a dependency and/or sequence is necessary, this is explicitly stated here or results in a manner obvious to the person skilled in the art when studying the specifically described configuration.

BRIEF DESCRIPTION OF THE DRAWINGS

Both the disclosure and the technical field are explained in more detail below with reference to the figures. It should be noted that the disclosure is not intended to be limited by the exemplary embodiments shown. In particular, unless explicitly stated otherwise, it is also possible to extract partial aspects of the subject matter outlined in the figures and to combine them with other components and knowledge from the present description and/or figures. In particular, it should be noted that the figures and in particular the size relationships shown are only schematic in nature. Identical reference symbols indicate the same objects, so that, where applicable, explanations from other figures can also be used. In the Figures.

DETAILED DESCRIPTION

Figure 1:
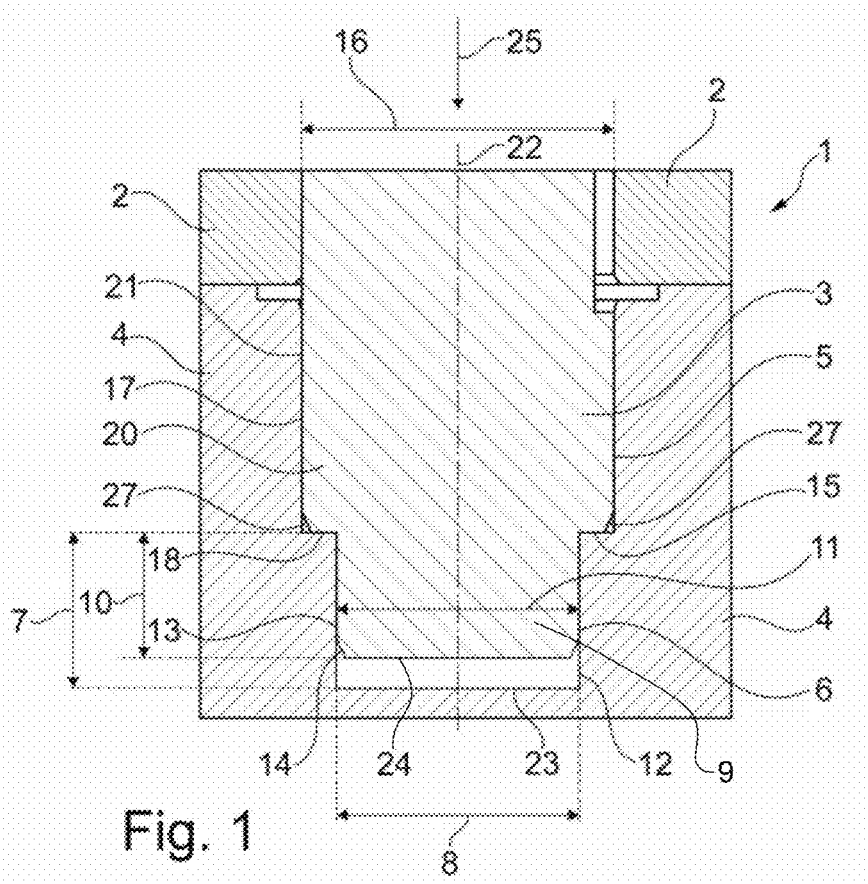
FIG. 1 shows a first example embodiment of a hydraulic pump unit.

FIG. 1 shows a detail of a hydraulic pump unit 1, which is part of a hydraulic system, not shown in detail, for example for actuating clutches or parking locks in the drive train of motor vehicles. The hydraulic pump unit 1 comprises a pump 2 and pillow block 3 for mounting the pump 2 in a housing 4. The pump 2 is can be designed as an external gear pump with two pump gears. The entire hydraulic pump unit 1 comprises a plurality of pillow blocks 3, for example two or three. The housing has a receptacle 5 for each pillow block 3, in which the pillow block 3 is accommodated. The receptacle 5 comprises a first region 6 of a first length 7 and a first diameter 8, which is designed as a blind hole. The first region 6 is cylindrical. A second region 9 of the pillow block 3 is accommodated and fixed in the first region 6 of the receptacle 5. The second region 6 has a second length 10 and a second diameter 11. The second length 10 is smaller than the first length 7, so that below the second region 6 and thus below the pillow block 3, a chip space 12 is formed, which is closed on the one hand by the housing 4 and on the other hand by the pillow block 3.

During assembly, the pillow block 3 is pressed into the receptacle 5 in a press-in direction 25. The second region 9 has a peripheral knurl 13 around its circumference, which is pressed into the first region 6 of the housing 4. The chips (not shown) produced during pressing are collected in the chip space 12. Since this is closed, they cannot escape from it and in particular cannot enter the pump 2 or a hydraulic line and cause damage there. In the present example, the pillow block 3 and thus also the knurl 13 are made of steel, while the housing 4 and thus also the first region 6 is made of an aluminum material, in particular an aluminum alloy, so that pressing in is possible with a comparatively little effort. The second region 9 has a circumferential chamfer 14, which on the one hand serves to center the pillow block 3 during assembly. At the same time, the chamfer 14 connects the knurl 13 to a chip space 12. This is formed between a base 23 of the first region 6 designed as a blind hole and an end face 24 of the second region 9 opposite the base 23. The chip space 12 accommodates chips produced when the knurl 13 is pressed into the first region 6, the chips being able to pass from the knurl 13 into the chip space 12 via the chamfer 14.

Furthermore, the receptacle 5 has a recess 15 in which the diameter of the receptacle 5 increases from the first diameter 8 in the first region 6 to a third diameter 16 and thus defines a third region 17 of the receptacle 5. As shown in FIG. 1, the first region 6 and the third region 17 are formed or constructed integrally with the receptacle 5 (or the housing 4). As a result, the recess 15 is also constructed integrally with the receptacle 5 and therefore could be described as being fixed or at least axially fixed to the receptacle 5. The third region 17 has a chamfer 27 which facilitates assembly and causes the third region 17 to be centered. The third region 17 is cylindrical. The pillow block 3 has a projection 18, in which the diameter of the pillow block 3 increases from the second diameter 11 in the second region 10 to a fourth diameter 19 and thus defines a fourth region 20 of the pillow block 4. The fourth region is positioned in the third region 17 of the receptacle 5, wherein the projection 18 of the pillow block 3 rests against the recess 15 of the receptacle 5. This creates a further barrier if a chip or chips is/are not pressed into the chip space 12 when the knurl 13 is pressed into the first region 6. A movement of the chip or chips in the direction of the pump 2 is reliably prevented by this barrier.

In the present example, the fourth region 20 has a press-fit region 21 which is cylindrical and is press-fitted with the third region 17. For this purpose, when the pillow block 3 is pressed into the receptacle 5 of the housing 4, the press-fit region 21 has a diameter that is larger than the third diameter 16. The press-fit region 21 can form part or all of the fourth region 20 viewed in the direction of a longitudinal axis 22 of the pillow block 3. The formation of a press fit between the press-fit region 21 and the third region 17 and the design of this region in the form of a cylinder achieves a high level of accuracy in the positioning of the pillow block 3 in the receptacle 5 of the housing 4. The pillow block 3, in particular the press-fit region 21 and the knurl 13, and the receptacle 5 are designed such that when the pillow block 3 is mounted in the receptacle 5, the press-fit region 21 comes into contact with the third region 17 first and only then does the knurl 13 come into contact with the first region 6. This can effectively prevent chips from entering the press-fit region.

The pre-centering via the press-fit region 21 allows the height of the knurl 13 in the direction of the longitudinal axis 22 to be kept small. This height of the knurl 13 is can be 30% of the diameter of the knurl 13 and more. As a result, the reshaping force to be applied during manufacture of the knurl 13 can be reduced, and at the same time the press-in forces during the assembly of the pillow block 3 in the receptacle 5 are reduced. At the same time, the tooth size of the knurl 13 in the direction of the longitudinal axis 22 is designed such that different temperature expansions of the housing 4 and the pillow block 3 are compensated for, so that the knurl 13 does not break off from the first region 6 even under extreme temperature conditions. In particular, tooth sizes of 0.2 mm and less, in particular 0.16 mm and less, are possible.

The knurl 13 allows the torque acting on the pillow block 3 to be absorbed and the pillow block to be supported on the housing 4. At the same time, simple assembly is ensured without chips being able to escape from the chip space 12.

The difference between the first length 7 and the second length 10 also creates a space that is large enough that the compression of the air present in the receptacle 5 during the assembly of the pillow block 3 is possible without causing excessive heating of the air or an excessive increase in air pressure and a resulting counterforce. Here, in particular, the difference between the first length 7 and the second length 10 is dimensioned such that the ratio of a first volume, which is the air-filled volume in the first region 6 and third region 17 of the receptacle 5 when the lower edge of the fourth region 20 rests against the upper edge of the third region 17, and a second volume, which corresponds to the air volume in the first region 6 in the assembled state (in this example identical to the volume of the chip space 12), is greater than about four. As a result, the counterforce created by the compression of the air in the first volume is limited and at the same time the heating of the air due to the compression is reduced.

Figure 2:
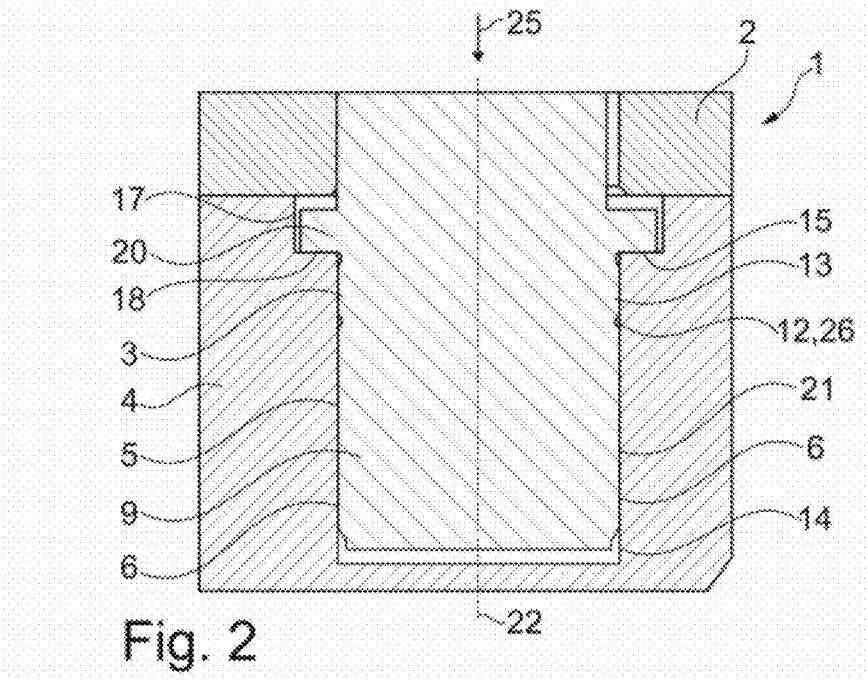
FIG. 2 shows a second example embodiment of a hydraulic pump unit.

FIG. 2 shows a second example of a hydraulic pump unit 1. Only the differences from the first example will be described here; in addition, reference is made to the above description of the first example in FIG. 1. In the second example, the knurl 13 is not formed adjacent to the end face 24 but is offset upwards counter to the press-in direction 25. Thus there is no connection between the knurl 13 and the blind hole of the first region 6. In order to nevertheless form a chip space 12, the second region 9 has a chip space 12 adjoining the knurl 13 in the press-in direction 25, which is formed as a groove 26. Here, also, the interaction of the projection 18 and the recess 15 causes an additional barrier for chips to be able to effectively prevent them from entering the pump 2. Here, the press-fitting region 21 is formed as part of the second region 9, which is cylindrical in design and is press-fitted with the first region 6.

A knurl 13 connects a pillow block 3 for a pump 2 to a housing 4 to form a hydraulic pump unit 1, in which the knurl 13 is pressed into a first region 6 of a receptacle 4 for the pillow block 3. The resulting chips can be accommodated in a chip space 12, which is further secured by a projection 18 of the pillow block 3 so that a movement of the chips towards the pump 3 can be prevented. The hydraulic pump unit 1 is simple to assemble, the torque of the pump 2 is absorbed by the knurl 13 and the pump is supported in the housing 4, so that precise operation of the pump 2 is possible. Furthermore, an anti-turn mechanism for the pillow block 3 is achieved.

LIST OF REFERENCE SYMBOLS

1 Hydraulic pump unit
2 Pump
3 Pillow block
4 Housing
5 Receptacle
6 First region
7 First length
8 First diameter
9 Second region
10 Second length
11 Second diameter
12 Chip space
13 Knurl
14 Chamfer
15 Recess
16 Third diameter
17 Third region
18 Projection
19 Fourth diameter
20 Fourth region
21 Press fit region
22 Longitudinal axis
23 Base
24 End face
25 Press-in direction
26 Groove
27 Chamfer

The invention claimed is:

1. A hydraulic pump unit, comprising:

a pump, at least one pillow block for mounting the pump, and a housing having a corresponding receptacle for each one of the at least one pillow block, and the corresponding receptacle including a first region having a first length, the first region shaped as a blind hole, and the at least one pillow block including a second region having a second length smaller than the first length, and the second region of the at least one pillow block is received by the first region of the corresponding receptacle, and a circumference of the second region of the at least one pillow block has a peripheral knurl extending at least over a portion of the second length, the peripheral knurl pressed into the first region so as to rotationally fix the at least one pillow block to the housing.

2. The hydraulic pump unit according to claim 1, wherein the second region includes a cylindrical press-fit region configured to be press-fit into the first region.

3. The hydraulic pump unit according to claim 1, wherein:

the corresponding receptacle further comprises an axially fixed recess having a third diameter, the axially fixed recess defining a third region of the corresponding receptacle, and a diameter of the corresponding receptacle increases from a first diameter in the first region to the third diameter, and the at least one pillow block further comprises a projection having a fourth diameter, the projection defining a fourth region of the at least one pillow block, and a diameter of the at least one pillow block increases from a second diameter in the second region to the fourth diameter, and the fourth region of the at least one pillow block is received by the third region of the corresponding receptacle such that the projection of the at least one pillow block rests against the axially fixed recess of the corresponding receptacle.

4. The hydraulic pump unit according to claim 3, wherein the fourth region has a cylindrical press-fit region configured to be press-fitted with the third region, and the fourth region and the second region are constructed integrally with the at least one pillow block.

5. The hydraulic pump unit according to claim 3, wherein a press-in direction of the at least one pillow block into the corresponding receptacle is defined, and the second region has a groove adjacent to the peripheral knurl in the press-in direction configured to serve as a chip space, the chip space configured to receive chips produced when the peripheral knurl is pressed into the first region, and the peripheral knurl is arranged between the axially fixed recess and the groove in an axial direction.

6. The hydraulic pump unit of claim 3, wherein the axially fixed recess is constructed integrally with the corresponding receptacle.

7. The hydraulic pump unit according to claim 1, wherein the housing is made of a first material with a first tensile strength and the at least one pillow block is made of a second material with a second tensile strength and a quotient of the second tensile strength divided by the first tensile strength is greater than 2.5.

8. The hydraulic pump unit according to claim 1, wherein the first region configured as a blind hole has a base opposite an end face of the second region, and a region between the base and the end face configured as a fixed volume chip space, the fixed volume chip space configured to receive chips produced when the peripheral knurl is pressed into the first region.

9. The hydraulic pump unit of claim 1, wherein a chip space is formed between an end face of the second region of the at least one pillow block and a base of the blind hole, and the chip space: i) is configured to receive chips produced as a result of the peripheral knurl being pressed into the blind hole, ii) is configured to house compressed air, and iii) does not have a ventilation opening.

10. The hydraulic pump unit of claim 1, wherein the second region of the pillow block further comprises a radially inwardly extending groove configured to form an enclosed chip space with the first region of the corresponding receptacle, the enclosed chip space configured to receive chips produced as a result of the peripheral knurl being pressed into the first region.

11. The hydraulic pump unit of claim 10, wherein the radially inwardly extending groove is adjoined to the peripheral knurl.

12. The hydraulic pump unit of claim 1, wherein the blind hole is constructed integrally with the housing.

13. The hydraulic pump unit of claim 12, wherein a chip space is formed between an end face of the second region of the pillow block and a base of the blind hole, and unvented compressed air is formed within the chip space.

14. The hydraulic pump unit of claim 13, wherein the chip space is bounded by:

the end face of the second region, the base of the blind hole, and a periphery of the blind hole.

15. A method for assembling a hydraulic pump unit, comprising:

providing a hydraulic pump unit, comprising:

a pump, at least one pillow block configured for mounting the pump, and a housing having a corresponding receptacle for each one of the at least one pillow block, and the corresponding receptacle having a first region formed integrally with the housing and configured as a blind hole of a first length, and the at least one pillow block having a second region of a second length smaller than the first length, and the second region has a peripheral knurl extending: i) around a circumference of the second region, and ii) at least over a subregion of the second length, and pressing the at least one pillow block into the corresponding receptacle so that: i) the peripheral knurl is pressed into the first region, and ii) the second region of the at least one pillow block is pressed into the first region of the corresponding receptacle.

16. The method according to claim 15, wherein the second region includes a cylindrical press-fit region configured to be press-fit to the first region.

17. The method of claim 16, wherein the cylindrical press-fit region is constructed integrally with the second region.

18. The method according to claim 15, wherein:

the corresponding receptacle further comprises an axially fixed recess having a third diameter, the axially fixed recess defining a third region of the corresponding receptacle, and a diameter of the corresponding receptacle increases from a first diameter in the first region to the third diameter, and the at least one pillow block further comprises a projection having a fourth diameter, the projection defining a fourth region of the at least one pillow block, and a diameter of the at least one pillow block increases from a second diameter in the second region to the fourth diameter and the fourth region of the at least one pillow block is received by the third region of the corresponding receptacle such that the projection of the at least one pillow block rests against the axially fixed recess of the corresponding receptacle.

19. The method according to claim 18, wherein the fourth region has a cylindrical press-fit region configured to be press-fitted with the third region.

20. The method according to claim 15, wherein when mounting the pump on the at least one pillow block, when the second region is pressed into the blind hole:

a chip space is formed between an end face of the second region of the pillow block and a base of the blind hole, and air is compressed without venting within the chip space.

* * * * *